US005551843A

United States Patent [19]

Hauser

[11] Patent Number: 5,551,843

[45] Date of Patent: Sep. 3, 1996

[54] PUMP WITH A DRIVING MOTOR AND A CASE

[75] Inventor: Erwin Hauser, Emmendingen-Kollmarsreute, Germany

[73] Assignee: KNF Neuberger GmbH, Freiburg-Munzingen, Germany

[21] Appl. No.: 332,001

[22] Filed: Oct. 31, 1994

[30] Foreign Application Priority Data

Nov. 9, 1993 [DE] Germany ..... 9317083 U

[51] Int. Cl.[6] ..... F04B 21/00

[52] U.S. Cl. ..... 417/234; 417/363; 417/413.1; 417/521

[58] Field of Search ..... 417/234, 363, 417/410.1, 411, 413.1, 423.14, 521

[56] References Cited

U.S. PATENT DOCUMENTS

| | | | |
|---|---|---|---|
| 1,911,804 | 5/1933 | Carpenter | 417/363 |
| 2,285,215 | 6/1942 | Lotz | 417/234 |
| 3,339,867 | 9/1967 | Bayless | 417/363 |
| 3,776,666 | 12/1973 | Ludwig . | |
| 4,648,809 | 3/1987 | Gensberger . | |
| 4,789,310 | 12/1988 | Hung | 417/313 |
| 4,961,018 | 10/1990 | Akhter . | |
| 5,052,909 | 10/1991 | Hakura | 417/413.1 |
| 5,055,000 | 10/1991 | Akhter . | |
| 5,158,153 | 10/1992 | Snow et al. | 417/539 |
| 5,163,818 | 11/1992 | Betsill et al. . | |

*Primary Examiner*—Charles Freay

*Attorney, Agent, or Firm*—Panitch Schwarze Jacobs & Nadel, P.C.

[57] ABSTRACT

A diaphragm pump with a driving motor has arranged in a case (5) at lease one drive (3) for transferring the pump movement to a pump diaphragm (4*a*). The case (5) of the diaphragm pump is essentially formed by at least one extrusion (6) configured to accommodate the drive(s) (3) and the driving motor (2). The extrusion (6) carries the driving motor (2), the drive(s) (3) and the pump head(s) (4). The extrusion (6) enables the pump case (5) to be specially dimensionally stable, to be manufactured at reasonable price, and has substantially smooth external surfaces. It is therefore easy to clean.

18 Claims, 3 Drawing Sheets

1
2
3
3a
3b
4
4a
4b
5
6
11
12
13
16
18
19
20
21
22
23
24
25
26
27
28
29
30
31
32
33
34
35
36
37
38
A
A

PUMP WITH A DRIVING MOTOR AND A CASE

FIELD OF THE INVENTION

The invention relates to a pump, particularly a diaphragm pump, with a driving motor having arranged in a case at least one drive for transferring the pump movement to a pump diaphragm or to a pump piston.

BACKGROUND OF THE INVENTION

Such pumps generally have a head unit containing the pump pares proper, a drive unit and a motor unit, each provided with a separate case manufactured from aluminum sand castings, aluminum permanent-mold castings or aluminum diecastings. While a disadvantage of the cases manufactured from aluminum die-castings lies particularly in the high tool costs, those made from aluminum sand castings and aluminum permanent-mold castings display large work tolerances, a tendency towards cavitation, and irregular, rough surfaces. These known pumps are therefore difficult to clean, particularly since dirt is apt to lodge at the transition points between the individual subassemblies and is hard to remove.

SUMMARY OF THE INVENTION

An object underlying the invention is therefore particularly to provide a pump of the kind mentioned at the outset with a case which can be manufactured at reasonable price, has a smooth surface, and lends itself well to cleaning.

This object is accomplished according to the present invention particularly in that the case is essentially formed by at least one extrusion which is configured to accommodate the drive and the driving motor and which carries the driving motor, the drive and the pump head. The extrusion, which can be produced cost-effectively and with high surface quality, enables the pump case to be formed with substantially smooth, easy-to-clean external surfaces. Since the case also accommodates the driving motor, a continuous, smooth case ensues which also protects the driving motor and the drive against dirt. The extrusion simultaneously serves as a dimensionally stable and rigid supporting member particularly well suited to the transfer of forces which arise in pumps between driving motor, drive and pump head.

It is advantageous if the extrusion has an approximately U-shaped cross section. Preferably at least the outer side faces of the U-limbs of the extrusion are of substantially smooth, continuous form. By this means a case is produced with substantially flat surfaces onto which the driving motor and the pump head can be mounted in a simple way. Since the U-section is open on one longitudinal side, the driving motor and the drive are easily accessible during assembly and pump maintenance. The continuous, smooth, outer side faces of the extrusion render the pump case insusceptible to accumulation of dirt and also can be easily cleaned.

The pump head and the driving motor are suitably mounted on the U-crosspiece of the extrusion. The high flexural strength of the U-crosspiece can then be utilized particularly well for the transfer of the forces arising in pumps between pump head, drive and driving motor.

An advantageous embodiment provides a base member preferably in the form of an extrusion, engaged by the free ends of the U-limbs of the extrusion. The longitudinal opening of the U-extrusion is thereby covered, so that the drive and driving motor arranged inside the extrusion are protected against accidental contact and also against dirt.

A further advantageous embodiment of the invention contemplates that the base member have longitudinal slots in each case engaging with the free end of one U-limb of the extrusion. By this means a form-locking, particularly stable connection is established between the base member and the extrusion.

A particularly suitable development of the invention contemplates that an elastic packing, preferably an elastomer, be provided in the slots, between the base member and the free ends of the U-limbs of the extrusion. By this means the vibrations occurring during pump operation and the accompanying solid-borne sound waves in the case are damped, particularly at the free ends of the U-limbs of the extrusion, thereby reducing the noise emission of the pump. In addition, unavoidable work tolerances of the extrusion and of the base member, such as variations in height of the U-limbs or slight bends in the longitudinal direction of the section, can be compensated for by the elastic material.

As additional protection against dirt and against contact, particularly with moving parts of driving motor and drive, it is expedient if a closing plate is provided at least one of the two end faces of the extrusion and preferably connects the extrusion to the base member. Such a closing plate can then, for example, be fixed to the extrusion and base member by retaining screws, so that additional retaining screws connecting the base member to the extrusion can be dispensed with.

An important further development of the invention contemplates that a fan wheel be provided in the extrusion and preferably be arranged on the drive shaft of the driving motor. By this means the inside cavity of the extrusion can be used as a cooling air channel, enabling particularly effective cooling, especially of the driving motor. For this purpose, air-permeable openings, preferably holes or slits, for the passage of cooling air are suitably provided in the closing plates.

A particularly advantageous embodiment of the invention contemplates that the base member take the form of a closed hollow or box section with preferably at least one axially extending cavity, the electrical interconnection of the pump suitably being arranged in at least one cavity. The electrical connections of the pump and any electronic pump control are then accommodated in a space separate from the rest of the case and therefore can be protected particularly well against splashwater. The observance of electrical safety regulations is thereby facilitated.

To increase the pump output, it is advantageous if two pump heads each with one drive are provided and if the pump heads and the drives are arranged on either side of the driving motor. This produces an almost entirely symmetrically arranged, two-stage pump in which the driving motor, including the two drives for the pump heads, is accommodated in a common case which can be manufactured at reasonable price and is easy to clean. In a symmetrical arrangement of the pump, identical components can be used for both pump stages.

It is contemplated that the pump has a carrying handle for easier transport. In the case of a two-stage pump it is expedient if the pump heads are arranged externally on the extrusion, preferably on the U-crosspiece, and the carrying handle is provided between the pump heads. Given a symmetrical configuration of the pump, the carrying handle then engages the case in the area of the center of gravity. In addition, there is the possibility of arranging the carrying handle in the area between the pump heads in a space-saving and preferably retractable manner.

An expedient development of the invention contemplates that the driving motor have mounting feet or the like and be secured with its mounting feet to the U-crosspiece of the extrusion. A commercial eletromotor, for instance, can then be used as the driving motor, turned 180° about its drive shaft, and be secured to the inside of the U-crosspiece with the mounting feet topside.

It is also advantageous if the outer side (edge) faces of the base member are approximately coplanar with the side faces of the U-limbs of the extrusion. The side faces of the case then form a virtually continuous, flat surface, which is especially easy to clean.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. The individual features may be realized singly or severally in an embodiment of the invention. In the drawings.

DETAILED DESCRIPTION OF PREFERRED EMBODIMENTS

Figure 1:
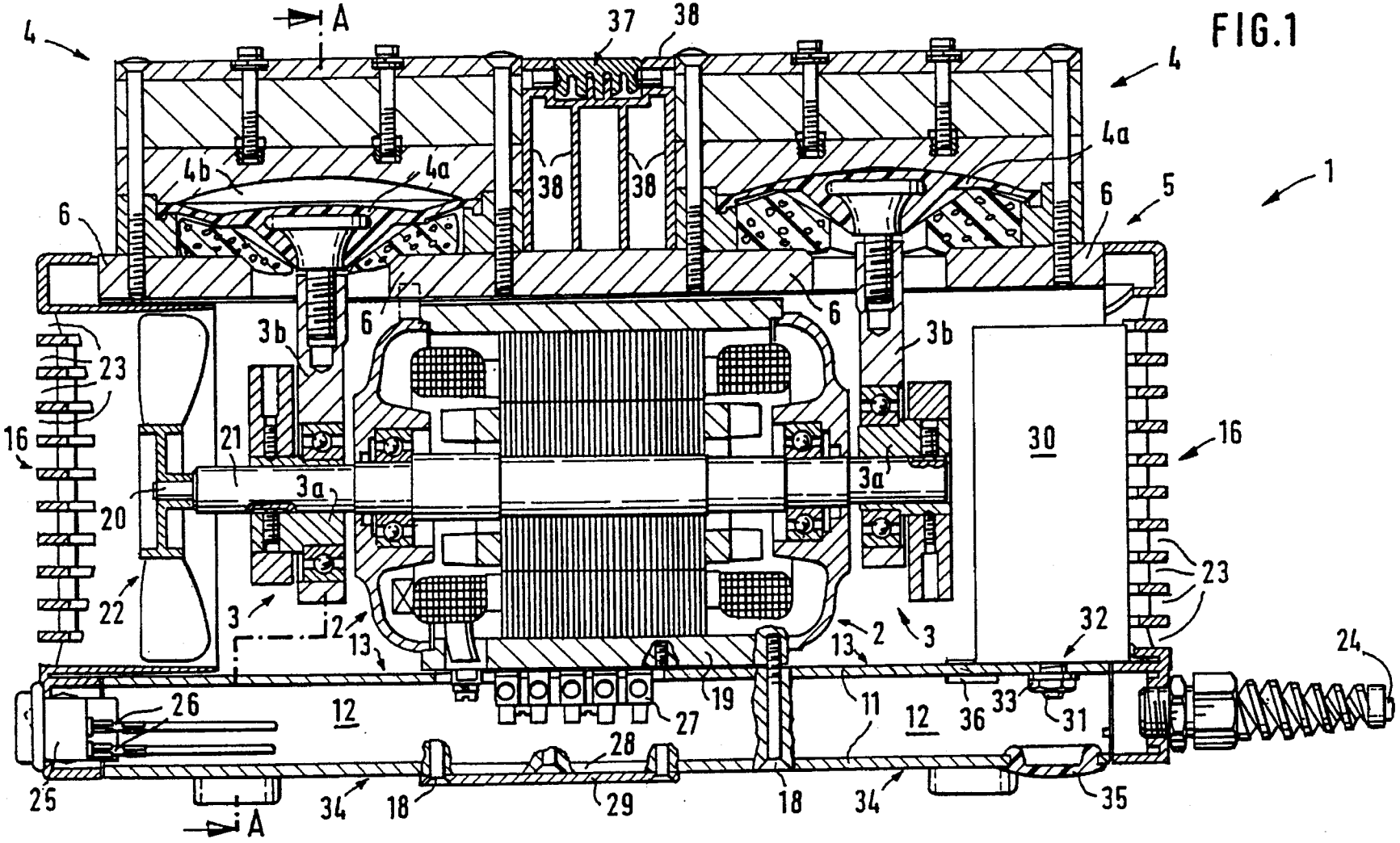
FIG. 1 is a cross-sectional view through the longitudinal median plan of a two-stage diaphragm pump according to the invention, wherein the pump heads and their drives are arranged on either side of the driving motor.

A two-stage pump 1 has a driving motor 2 with the drives 3 for the two pump heads 4 arranged on either side of the driving motor 2. The drives 3 are composed in the usual way as a crank mechanism with a crankpin 3*a* which is arranged eccentrically to the drive shaft 21 of the driving motor 2 and carries a connecting rod 3*b*. The pump heads 4 take the form of a diaphragm pump heads. The pump chamber 4*b* is defined below by the diaphragm 4*a*, and is provided in the usual way with valve-controlled inlet and outlet openings 4*c*, 4*d*. Unlike FIGS. 1 and 2, piston pump heads might be provided instead of the diaphragm pump heads 4.

The case 5 of the pump 1 is essentially composed of an extrusion 6 of U-shaped cross-section, extending approximately throughout the length of the pump 1 and carrying the driving motor 2, the drives 3 and the pump heads 4. The pump 1 therefore has a continuous case 5 which extends over all the important subassemblies of the pump 1 and enables good transfer of the forces arising in pumps between driving motor 2, drives 3 and pump heads 4. The outer side faces 7 of the U-limbs 8 of the extrusion 6 are of substantially smooth, continuous form, so that the case 5 is insusceptible to dirt accumulating and can be cleaned easily. In addition, the smooth, large side faces 7 enhance the design of the pump 1. Since a commercial extrusion 6 can be used for producing the supporting structure of the case 5, the manufacturing costs for the case 5 can be reduced. It is not necessary to use special casting molds or the like. The driving motor 2 and the pump heads 4 are suitably mounted onto the U-crosspiece 9 of the extrusion 6. Advantage can then be derived from the large bending movement of the U-crosspiece 9 for the transfer of the forces arising in pumps between the driving motor 2, the drives 3 and the pump heads 4.

Engaging the free ends 10 of the U-limbs 8 is a base member 11 which closes the longitudinal opening of the extrusion 6 and protects the driving motor 2 and the drives 3 against dirt as well as serving as protection against accidental contact. The base member 11 has at each of the two longitudinal edges of its upper side 13 a longitudinal slot 14 in each case engaging with the free end 10 of one U-limb 8 of the extrusion 6. An elastic packing, preferably an elastomer 15, is provided in the longitudinal slots 14, between the base member 11 and the free ends 10 of the extrusion 6. The elastomer 15 serves on the one hand to dampen solid-borne sound vibrations, as may occur in the case 5 and particularly at free ends 10 of the extrusion 6 during pump operation, and thereby to reduce the running noise of the pump 1. On the other hand, the elastomer 15 compensates for shape tolerances and work tolerances of the extrusion 6 and base member 11. This is advantageous particularly since, with extrusions, production-conditioned variations in height of the U-limbs 8 and slight bends in the longitudinal direction of the section cannot be entirely excluded.

A closing plate 16, as protection against accidental contact and as a screen and protection against dirt, is provided at each of the end openings of the extrusion 6 and is fixed with retaining screws which engage with complementary tapped holes 17 in the extrusion 6 and base member 11 and detachably interconnect them. If required, additional retaining screws 18 can be provided which fix the base member 11 to the stator frame 19 of the drive motor 2. No retaining screws are provided between the base member 11 and the free ends 10 of the U-limbs 8 of the extrusion 6, so as not to detract from the vibration-damping effect of the elastomer 15.

Inside the extrusion 6 a fan wheel 22 driven by the driving motor 2 is provided at one end 20 of the drive shaft 21 and supplies the driving motor 2 with an axially directed, cooling air current. The closing plates 16 have for this purpose air-permeable slits 23 through which the cooling air can enter and leave the end openings of the extrusion 6. The extrusion 6 hence composes a cooling air channel enabling particularly effective cooling, especially of the driving motor 2.

Figure 2:
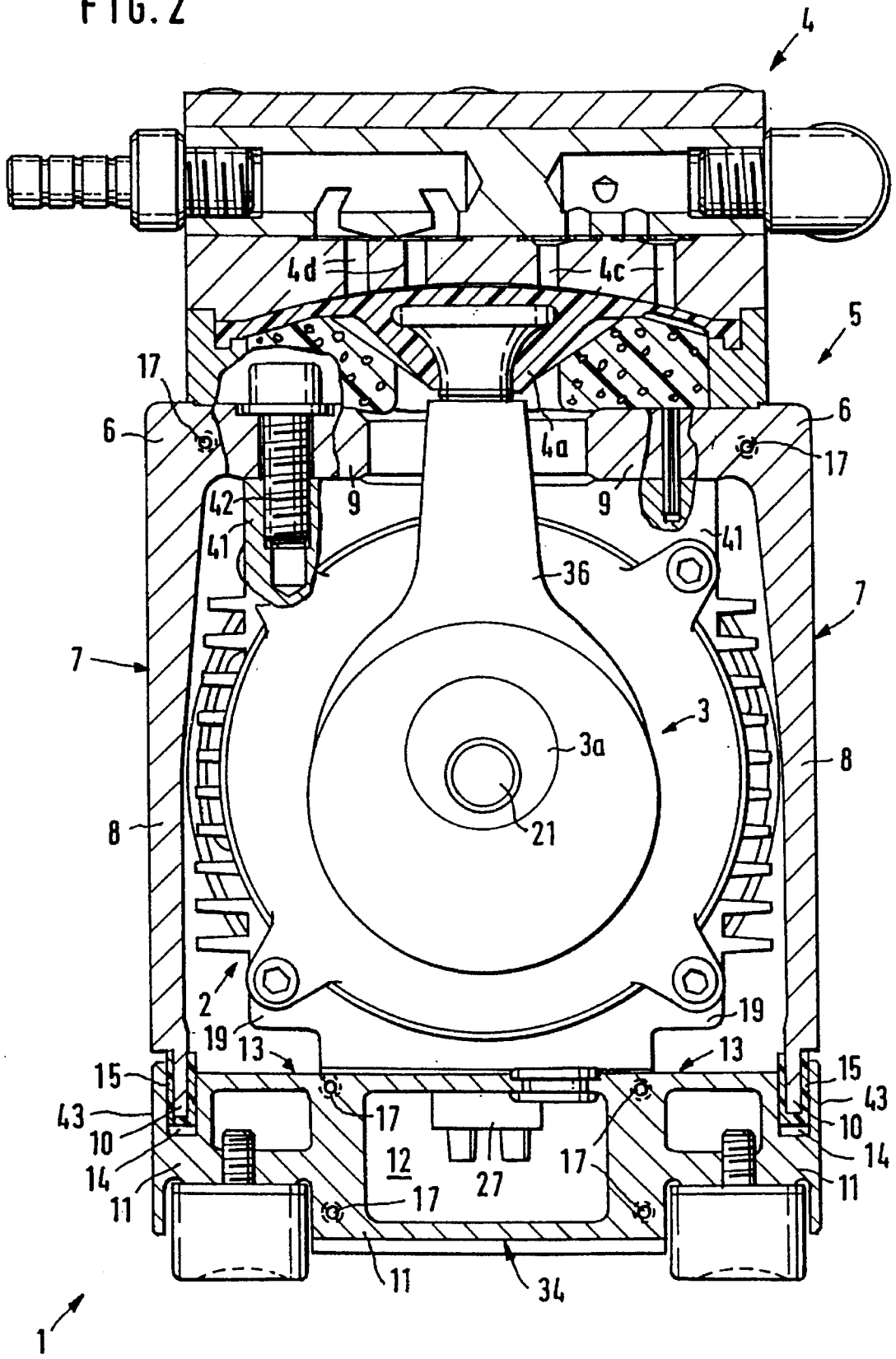
FIG. 2 is a slightly enlarged cross-sectional view through the stepped plane A-A of the pump as shown in FIG. 1.

The base member 11 takes the form of a closed hollow or box section and has an axially extending cavity 12. The end faces of the base member 11 are closed by the closing plates 16, so that the cavity 12 forms a confined space in which the electrical interconnection of the pump 1 can be accommodated so as to be contact-protected and splash-proof. FIG. 1 shows the power supply cable 24 led into the cavity 12 through the right-hand closing plates 16 and, fitted in the left-hand closing plates 16, a switch 25 for switching the pump i on and off, the connection contacts 26 of the switch projecting into the cavity 12. The connecting terminals 27 for the driving motor 2 are likewise provided in the cavity 12 of the base member 11, approximately centrally beneath the driving motor 2. In order that the connecting terminals 27 are easily accessible, the base member 11 has an opening 28 covered by a lid 29 detachably connected to the base member 11.

The base member 11 also carries the capacitor 30 for power-factor correction of the driving motor 2. The capacitor 30 is arranged in the U-extrusion 6 at the end facing away from the fan wheel 22. By this means an outwardly symmetrical arrangement of the pump 1 ensues, inside which are provided at one end of the extrusion 6 the fan wheel 22 and at the other end the capacitor 30. The capacitor 30 is inserted with the threaded bolt 31 arranged at its front end into the bore 32 in the upper side 13 of the base member 11 and is fixed thereto by the retaining nut 33. In order to improve access to the retaining nut 33, an opening closable by stopper 35 is provided at the underside 34 of the base member 11. A cable bushing 36 is provided in the upper side 13 of the base member 11 for leading through the connecting cables of the capacitor 30.

The pump 1 further has a carrying handle 37 arranged between the pump heads 4 which are fitted externally on the U-crosspiece 9. The carrying handle 37 is thereby approximately in the area of the center of gravity of the pump 1, so that the pump is easy to carry. A connecting piece 38 is provided filling the space between the two pump heads 4, and the carrying handle 37 is retractable into the outer contour of the connecting piece 38. FIG. 1 illustrates the carrying handle 37 at rest, retracted into the connecting piece 38, showing that the upper side of the carrying handle 37, connecting piece 38 and pump heads 4 are flush, producing a practically flat surface at the upper side of the pump 1 as well.

Figure 3:
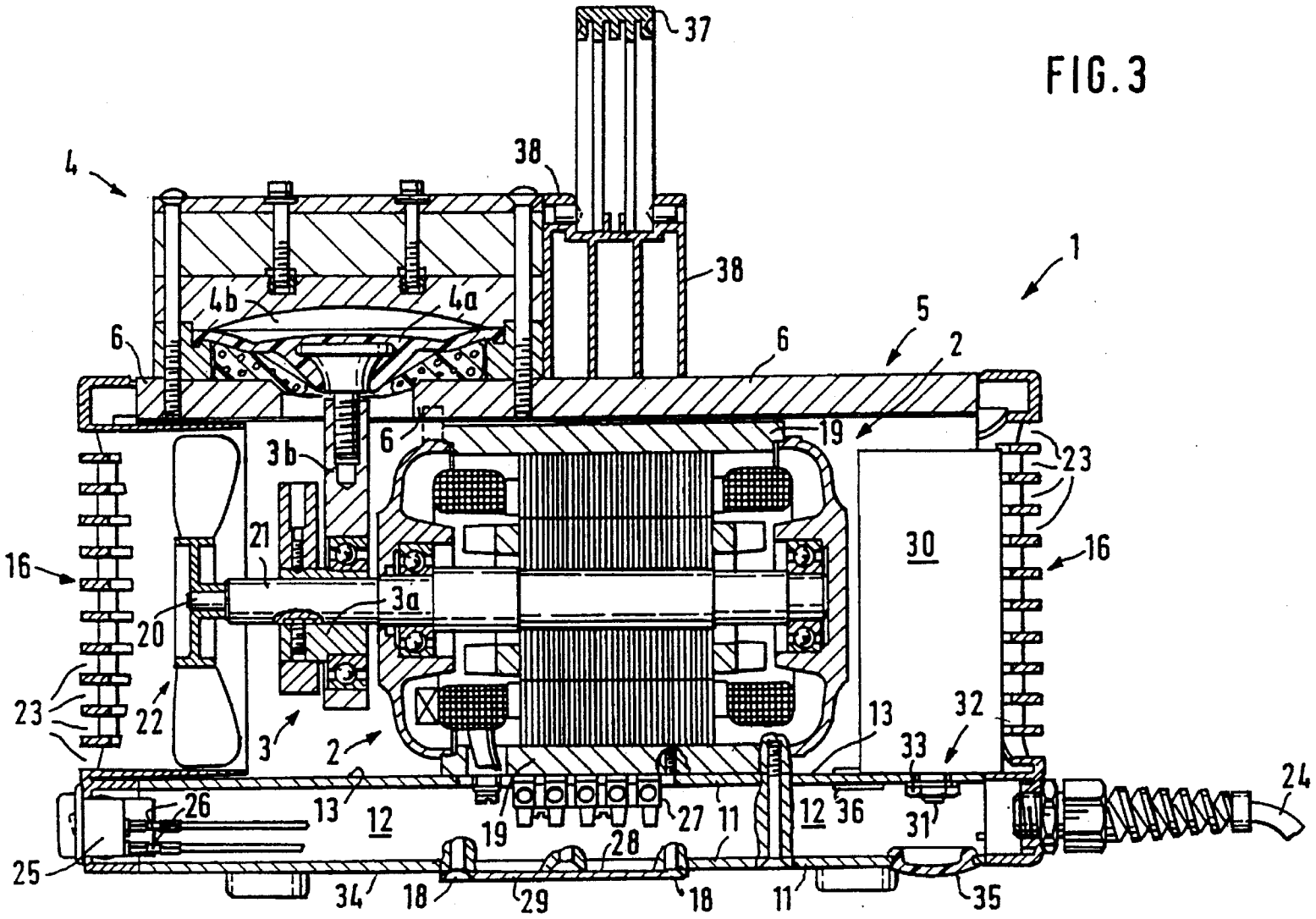
FIG. 3 is a cross-sectional view through the longitudinal median plane of a single-stage diaphragm pump according to the invention.

FIG. 3 shows a further exemplary embodiment with a single-stage pump 1, in which the carrying handle 37 is in the position of use. In the case of this pump 1, which has a center of gravity displaced somewhat compared to that shown in FIG. 1, the carrying handle 37 can also be arranged at the side of the pump head 4, approximately centrally above the driving motor 2. When carrying the pump 1 by the handle 37, the pump tips slightly about its transverse axis due to the displaced center of gravity, but this only negligibly detracts from the function of the carrying handle 37.

The driving motor 2 is screwed with its mounting feet 41 to the U-crosspiece 9 of the extrusion 6 by fastening screws 42. A special advantage can then be derived from the high flexural strength of the U-crosspiece 9 for the transfer of the forces arising in pumps between the driving motor 2, the drives 3 and the pump heads 4. Compared to its usual position of use, the driving motor 2 is incorporated in the extrusion 6 so as to be turned 180° about its drive shaft and secured to the extrusion 6 with its mounting feet 41 topside.

The outer side faces 43 of the base member 11 are approximately coplanar with the side faces 7 of the U-limbs 8. The side faces of the case 5 thereby form a virtually continuous, flat surface, which is especially easy to clean.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A pump comprising a driving motor, at least one pump head, at least one drive for transferring pump movement from the driving motor to a pump head, and a case (5) essentially formed as at least one extrusion (6) configured to accommodate therein said at least one drive (3) and the driving motor (2), said case carrying the driving motor (2) and said at least one drive (3) therein, and the pump head (4) being mounted on the case, the extrusion 16) having an approximately U-shaded cross section with U-limbs (8) and a U-crosspiece (9), the at least one pump head (4) and the driving motor (2) being mounted on the U-crosspiece (9) of the extrusion (6).

2. A pump as claimed in claim 1, wherein at least outer side faces (7) of the U-limbs (8) of the extrusion (6) are of substantially smooth, continuous form.

3. A pump as claimed in claim 1, wherein a base member (11) is provided across the U-shaped extrusion and is engaged by free ends (10) of the U-limbs (8).

4. A pump as claimed in claim 3, wherein the base member (11) is in the form of an extrusion.

5. A pump as claimed in claim 3, wherein the base member (11) has longitudinal slots (14), each engaging the free end (10) of one U-limb (8).

6. A pump as claimed in claim 5, wherein an elastic packing (15) is provided in the slots (14) between the base member (11) and the free ends (10).

7. A pump as claimed in claim 1, wherein said pump is a diaphragm pump.

8. A pump as claimed in claim 1, wherein a closing plate (16) is provided on at least one of two end faces of the extrusion (6).

9. A pump as claimed in claim 8, wherein each closing plate (16) connects the extrusion (6) to a base member (11).

10. A pump as claimed in claim 8, wherein each closing plate (16) has air-permeable openings for passage of cooling air.

11. A pump as claimed in claim 1, wherein a fan wheel (22) is provided in the extrusion (6) and arranged on a drive shaft (21) of he driving motor (2).

12. A pump comprising a driving motor, two pump heads (4), each pump head (4) having one drive (3) for transferring pump movement from the driving motor to the respective pump head, the pump heads (4) and the drives (3) are arranged on either side of the driving motor (2), and a case (5) essentially formed as at least one extusion (6) configured to accomodate therein said drives (3) and the driving motor (2), said case carrying the driving motor (2) and the drives (3) therein, and the two pump heads (4) are arranged externally on the extrusion (6), and a carrying handle (37) is provided between the pump heads.

13. A pump as claimed in claim 12, wherein the carrying handle (37) is retactable.

14. A pump comprising a driving motor, at least one pump head, at least one drive for transferring pump movement from the driving motor to the pump head, and a case (5) essentially formed as at least one extrusion (6) configured to accommodate therein said at least one drive (3) and the driving motor (2), said case carrying the driving motor (2) and said at least one drive (3) therein, and the pump head (4) being mounted on the case, the extrusion (6) having an approximately U-shaped cross section with U-limbs (8) and a U-crosspiece (9), the driving motor (2) having mounting feet (41) which secure the driving motor (2) to the U-crosspiece (9) of the extrusion (6).

15. A pump comprising a driving motor, at least one pump head, at least one drive for transferring pump movement from the driving motor to a pump head, and a case (5) essentially formed as at least one extrusion (6) configured to accommodate therein said at least one drive (3) and the driving motor (2), said case carrying the driving motor (2) and said at least one drive (3) therein, and the pump head (4) being mounted on the case, the extrusion (6) having an approximately U-shaped cross section with U-limbs (8) and a U-crosspiece (9), the U-limbs (8) including side faces (7) and free ends (10), and a base member (11) located across the U-shaped extrusion and engaged by the free ends (10) of the U-limbs (8), the base member (11) including outer side faces (43) which are approximately coplanar with the side faces (7) of the U-limbs (8).

16. A pump comprising a driving motor, at least one pump head, at least one drive for transferring pump movement from the driving motor to the pump head, and a case (5) essentially formed as at least one extrusion (6) configured to accommodate therein said at least one drive (3) and the driving motor (2), said case carrying the driving motor (2) and said at least one drive (3) therein, and the pump head (4) being mounted on the case, the extrusion (6) having an approximately U-shaped cross section with U-limbs (8) and a U-crosspiece (9), a base member (11) being provided across the U-shaped extrusion and engaged by free ends (10) of the U-limbs, the base member having a closed hollow cross section with at least one axially extending cavity, for carrying electrical interconnection of the pump (1) therein.

17. A pump as claimed in claim 16, wherein a closing plate (16) is provided on each end face of the extrusion (6) and the closing plates (16) connect the extrusion (6) to the base member (11), the base member (11) having open ends, and the closing plates (16) close the open ends of the base member (11) to form a splash-proof cavity (12) for the electrical interconnection of the pump (1).

18. A pump as claimed in claim 17 wherein a switch (25) is provided in one closing plate (16) in communication with the cavity (12) and an electrical connection (24) is provided in the other closing plate (16) in communication with the cavity (12).

* * * * *